US007237591B2

(12) United States Patent
Snyder et al.

(10) Patent No.: US 7,237,591 B2
(45) **Date of Patent: *Jul. 3, 2007**

(54) RETRACTABLE SAFETY BARRIER

(75) Inventors: Ronald P. Snyder, Dubuque, IA (US); Jason D. Miller, Alden, IA (US); Donald P. Grant, Dubuque, IA (US); Paul J. Maly, Mequon, WI (US); Mike Gallenberger, Thiensville, WI (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/412,332

(22) Filed: Apr. 27, 2006

(65) Prior Publication Data

US 2006/0191644 A1 Aug. 31, 2006

Related U.S. Application Data

(63) Continuation-in-part of application No. 10/809,119, filed on Mar. 25, 2004, now Pat. No. 7,207,370.

(51) Int. Cl.
*E06B 9/08* (2006.01)

(52) U.S. Cl. ..... 160/23.1; 160/293.1; 160/294; 242/380

(58) Field of Classification Search ..... 160/264, 160/275, 290.1, 291, 293.1, 294, 305, 23.1, 160/24, 340; 242/380
See application file for complete search history.

(56) References Cited

U.S. PATENT DOCUMENTS 516,486 A 3/1894 Hartshorn
778,228 A 12/1904 Dodge et al.
824,930 A 7/1906 Hopkins
1,477,159 A 12/1923 Zinser
1,652,186 A 12/1927 Strauss
1,666,508 A 4/1928 Sawyer
1,828,296 A 10/1931 Sawyer
RE18,940 E 9/1933 Traut (Continued)

OTHER PUBLICATIONS

Patent Cooperation Treaty, "International Search Report" Jun. 26, 2006. 2 pages.
Patent Cooperation Treaty, "Written Opinion" Jun. 26, 2006. 3 pages.
Product Brochure showing safety products of JD Metalworks, dated Jul. 9, 2003, 8 pages.
Web page advertising DockStrap(TM) product from Gaylord Material Handling, dated May 14, 2002, 1 page.

*Primary Examiner*—Blair M. Johnson
(74) *Attorney, Agent, or Firm*—Hanley, Flight & Zimmerman LLC

(57) ABSTRACT

A retractable barrier includes a rollup or otherwise retractable panel that can extend between two spaced apart support members. When not in use, the panel can retract onto one of the support members to permit passage. The barrier provides substantial impact resistance by having the reactive force of the impact transfer directly between the barrier's retractable panel and its support members without having to rely on the strength of the panel's take-up roller or the strength of the roller's anti-rotation mechanism. This can be accomplished by having a slot-engaging stop member mounted directly to the panel itself. The stop member is preferably a pipe, rod, bar or some other vertically elongate member that can broadly distribute an impact reactive force over the height of the panel. In some embodiments, the barrier can be set for various doorway widths by simply repositioning the stop member's location on the retractable panel.

20 Claims, 12 Drawing Sheets

U.S. PATENT DOCUMENTS

| | | | |
|---|---|---|---|
| 2,088,046 | A | 7/1937 | White |
| 2,295,205 | A | 9/1942 | Fraser |
| 2,678,691 | A | 5/1954 | Rust et al. |
| 3,090,425 | A | 5/1963 | Carlo |
| 3,115,182 | A | 12/1963 | Bobbitt |
| 3,146,824 | A | 9/1964 | Veilleux |
| 3,314,468 | A | 4/1967 | Riedel |
| 3,581,798 | A | 6/1971 | Malamed |
| 3,803,943 | A | 4/1974 | Woloszyk |
| 4,356,668 | A | 11/1982 | Wagner |
| 5,005,827 | A | 4/1991 | Steinbrecher |
| 5,029,819 | A | 7/1991 | Kane |
| 5,050,846 | A | 9/1991 | Goodman et al. |
| 5,078,197 | A | 1/1992 | Weishar |
| 5,118,056 | A | 6/1992 | Jeanise |
| 5,170,829 | A | 12/1992 | Duncan et al. |
| 5,271,183 | A | 12/1993 | Hahn et al. |
| 5,299,386 | A | 4/1994 | Naegelli et al. |
| 5,353,859 | A | 10/1994 | Oltahfer et al. |
| 5,459,963 | A | 10/1995 | Alexander |
| 5,503,211 | A | 4/1996 | Engi |
| 5,505,244 | A | 4/1996 | Thumann |
| 5,564,238 | A | 10/1996 | Ellis |
| 5,624,203 | A | 4/1997 | Jackson et al. |
| 5,636,679 | A | 6/1997 | Miller et al. |
| 5,649,396 | A | 7/1997 | Carr |
| 5,660,144 | A | 8/1997 | Venti |
| 5,690,317 | A | 11/1997 | Sandsborg |
| 5,752,557 | A | 5/1998 | Crider et al. |
| 5,823,705 | A | 10/1998 | Jackson et al. |
| 5,875,597 | A | 3/1999 | Gingrich et al. |
| 6,056,038 | A | 5/2000 | Foster et al. |
| 6,186,274 | B1 | 2/2001 | Reynolds et al. |
| 6,244,324 | B1 | 6/2001 | Quates et al. |
| 6,279,276 | B1 | 8/2001 | Knoll |
| 6,375,164 | B1 | 4/2002 | Siegler et al. |
| 6,375,165 | B1 | 4/2002 | Sherratt et al. |
| 6,485,225 | B1 | 11/2002 | Baker |
| 6,536,502 | B2 | 3/2003 | Britto et al. |
| 6,575,435 | B1 | 6/2003 | Kotzen |
| 6,595,496 | B1 | 7/2003 | Langlie et al. |
| 6,688,480 | B1 | 2/2004 | Denny |
| 6,715,973 | B2 | 4/2004 | Faber et al. |
| 6,733,204 | B1 | 5/2004 | Paniccia |
| 6,776,398 | B1 | 8/2004 | Tsai |
| 6,807,999 | B1 | 10/2004 | Bowen et al. |
| 6,830,236 | B2 | 12/2004 | de Lorenzo |
| 2002/0170688 | A1 | 11/2002 | Daus et al. |
| 2003/0016996 | A1 | 1/2003 | Gelfand et al. |
| 2003/0079845 | A1 | 5/2003 | Stern, Jr. |
| 2003/0111657 | A1 | 6/2003 | Green |

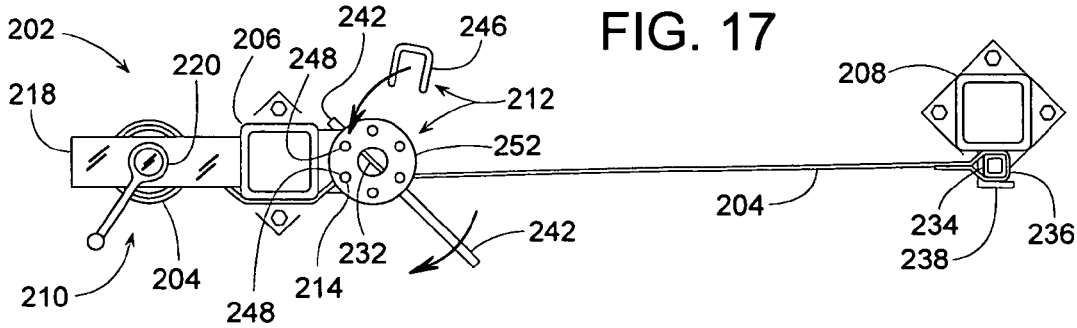
FIG. 17
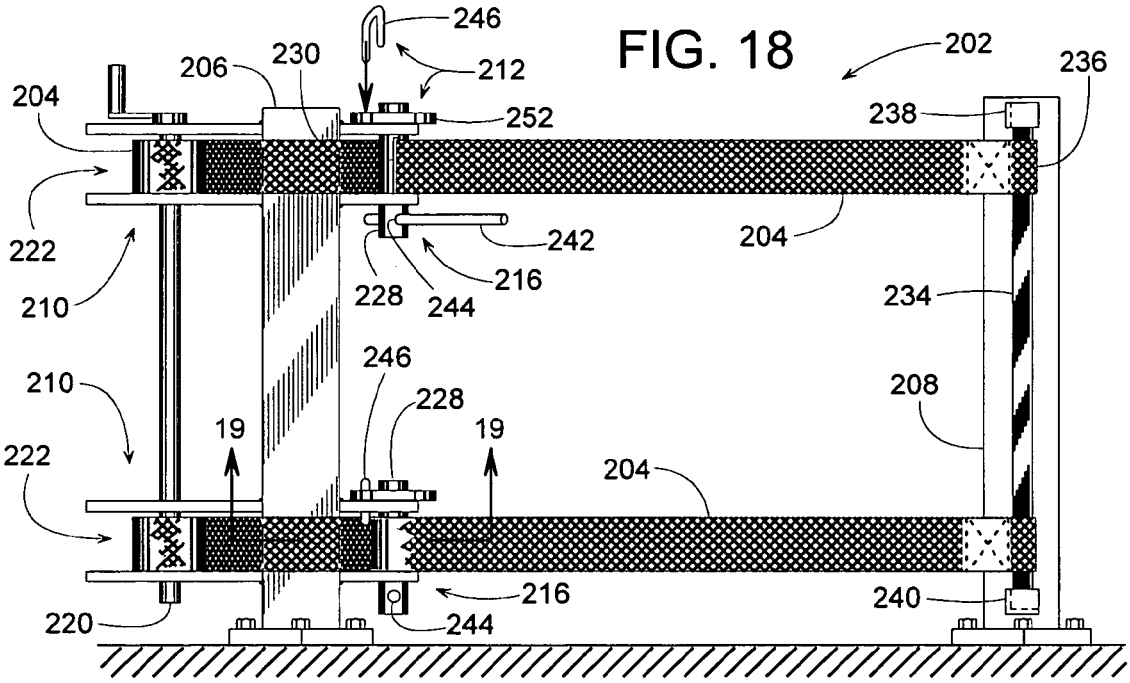
FIG. 18
FIG. 19
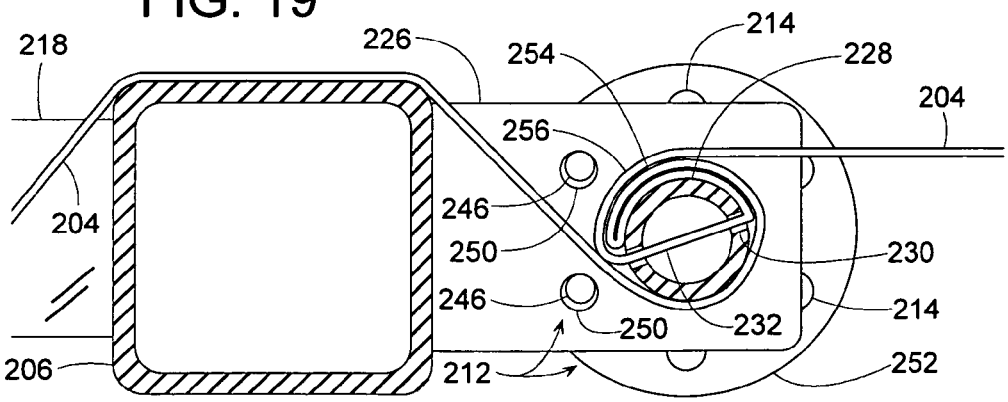

RETRACTABLE SAFETY BARRIER

CROSS REFERENCE TO RELATED APPLICATION

This application is a continuation-in-part of U.S. patent application Ser. No. 10/809,119 entitled "Retractable Safety Barrier," filed Mar. 25, 2004 now U.S. Pat. No. 7,207,370, and incorporated herein by reference in its entirety.

BACKGROUND

This disclosure generally pertains to retractable safety barriers and more specifically to a heavy-duty barrier whose design features make it particularly suitable for impeding heaving loads such as, for example, a forklift at a loading dock platform.

DESCRIPTION OF RELATED ART

Many retractable safety barriers for doorways have been developed to help prevent children and pets from entering certain areas. To selectively open or block a doorway, some barriers include a rollup panel that can be unrolled to extend across and block the doorway. When not in use or to allow passage, the panel can wrap about a roller for storage along one side of the doorway. A few examples of retractable barriers with rollup panels are disclosed in U.S. Pat. Nos. 5,636,679; 5,690,317; 6,536,502; 5,505,244; and 6,056,038.

Once such a rollup panel is extended across a doorway, usually some type of locking mechanism helps prevent the panel from unwrapping any farther so that the child or pet is unable to force the panel open. Such locking mechanisms typically include a little tab or pawl that engages a ratchet or some other type of tooth or slotted wheel, which in turn is coupled to the roller about which the panel is wrapped. The tab or pawl engaging the wheel hopefully prevents the roller from releasing the panel any farther. This may work well for light duty applications involving children and pets; however, such barriers do not appear adequate for industrial applications.

In factories, for example, a forklift and other material handling equipment may need to travel near operating equipment such as machine tools (machining centers, turning centers, etc.). A permanent guardrail may prevent a forklift from striking the machine, but the guardrail may also interfere with material handling equipment trying to load and unload the machine of its work pieces. While a permanent guardrail may be effective at preventing a forklift from striking a machine, forklift impact with a traditional; rigid guardrail often results in significant and permanent damage to the guardrail.

Truck loading docks may also have a need for a retractable barrier. A barrier may help prevent dockworkers and material handling equipment from accidentally falling off the edge of the dock's elevated platform. The platform's height is about the same as that of an average truck bed. Although a door typically exists at the edge of the platform, the door's strength may be insufficient to withstand the impact of a forklift, or the door may be left open for various reasons. The door, for instance, may be left open simply because the weather is nice, and the workers inside would like to enjoy some fresh air. With the door open, however, the loading dock platform may create a safety problem.

Although costly massive safety gates have been used at loading docks, they can take up a lot of space even when they are opened to allow passage through the doorway. Even though they may be able to stop a slowly moving forklift, an impact can cause considerable damage to the gate due to the gate's limited ability to resiliently absorb the impact. Also, permanent or other conventional guarding may not be suitable for loading dock areas, as such guarding may interfere with operating the door, loading and unloading trucks, and operating a dock leveler that may be installed at the platform.

A dock leveler is often installed at the loading dock platform to compensate for a height difference that may exist between the platform and the bed of the truck. A dock leveler typically includes a deck that is hinged at its back edge to raise or lower its front edge to generally match the height of the truck bed. Often an extension plate or lip is pivotally coupled to the deck to bridge the gap between the deck's front edge and a back edge of the truck bed. The deck and extended lip provide a path for forklifts to travel between the loading dock platform and the truck bed, thus facilitating loading or unloading of the truck. Unfortunately, a conventional barrier or guardrail extending over the dock leveler may restrict the deck's upward pivotal motion.

Since a dock leveler and the adjacent door move in the area where guarding may be needed, it becomes challenging to provide the area with a barrier that is movable yet sufficiently strong to impede heavy material handling equipment. Thus, a need exists for a movable, heavy-duty industrial barrier, which is more compact in its stored position, is more capable of stopping a forklift without significant damage, and incorporates a more cost-efficient design.

SUMMARY

In some embodiments, a retractable rollup barrier is provided with substantial impact resistance by having the reactive force of the impact transfer directly between the barrier's retractable panel and its vertical support members without having to rely on the strength of the panel's take-up roller or the strength of the roller's anti-rotation mechanism.

In some embodiments, a retractable rollup barrier includes a stop member that is carried by the rollup panel itself.

In some embodiments, the stop member is an elongate member, such as a pipe, rod or bar that broadly distributes an impact reactive force over the height of the rollup panel.

In some embodiments, the stop member comprises multiple separate members on the same vertical line. The separate members could be a series of pipes, rods, or bars that work together to broadly distribute an impact reactive force over the height of a retractable panel.

In some embodiments, a retractable rollup barrier can be set for various doorway widths by simply repositioning a stop member's location on the rollup panel.

In some embodiments, the extent to which a rollup panel can extend out from within a housing is limited by a thicker section of the panel being unable to fit through a narrower slot in one of the barrier's support members.

In some embodiments, a retractable panel includes reinforcing straps that greatly increase the panel's strength.

In some embodiments, the reinforcing straps of the retractable panel can be of a different color than the rest of the panel so that the panel is clearly visible when in use.

In some embodiments, the panel includes a large warning label that is visible from a distance so that people in the area can see that a drop-off hazard exists even though a closed dock door may disguise the danger.

In some embodiments, the rollup panel does not reach its full extension from within its housing until the panel experiences an impact. This feature allows a distal end of the panel to be readily hooked or unhooked from an anchored support member without the panel having to be pulled tightly against a hard stop to do so.

In some embodiments, a retractable barrier straddles a dock leveler.

In some embodiments, two anchor support members of a retractable barrier can serve as bollard-like members for protecting the lateral edges of a door from damage.

In some embodiments, a distal end of a retractable panel can retract and stow within a pocket of a support member housing to protect the distal end from damage and avoid interfering with traffic when the retractable barrier is not in use.

In some embodiments, a retractable safety barrier comprises a flexible strap that is supported by two take-up members, wherein a first take-up member provides storage for the strap and a second take-up member provides a way of tightening the strap when in use. When the strap receives an impact, the second take-up member reacts more of the impact than does the first take-up member, thus the first take-up member can be more light duty.

In some embodiments, a safety barrier system with a flexible strap includes an incremental stop mechanism that provides the strap with a plurality of spaced-apart stopping points, whereby the strap does not have to rely on friction to resist an impact.

In some embodiments, a safety barrier system includes a first take-up member for storing an impactable strap, an incremental stop mechanism for providing the strap with a plurality of spaced-apart stopping points, and a second take-up member for adjusting the tension in the strap with infinite adjustability.

BRIEF DESCRIPTION OF THE DRAWINGS

FIG. 17 is a top view similar to FIG. 15 but showing the barrier being tightened and locked in placed.

FIG. 18 is a front view of FIG. 17.

FIG. 19 is a cross-sectional view taken along line 19-19 of FIG. 18.

DESCRIPTION

Figure 1:
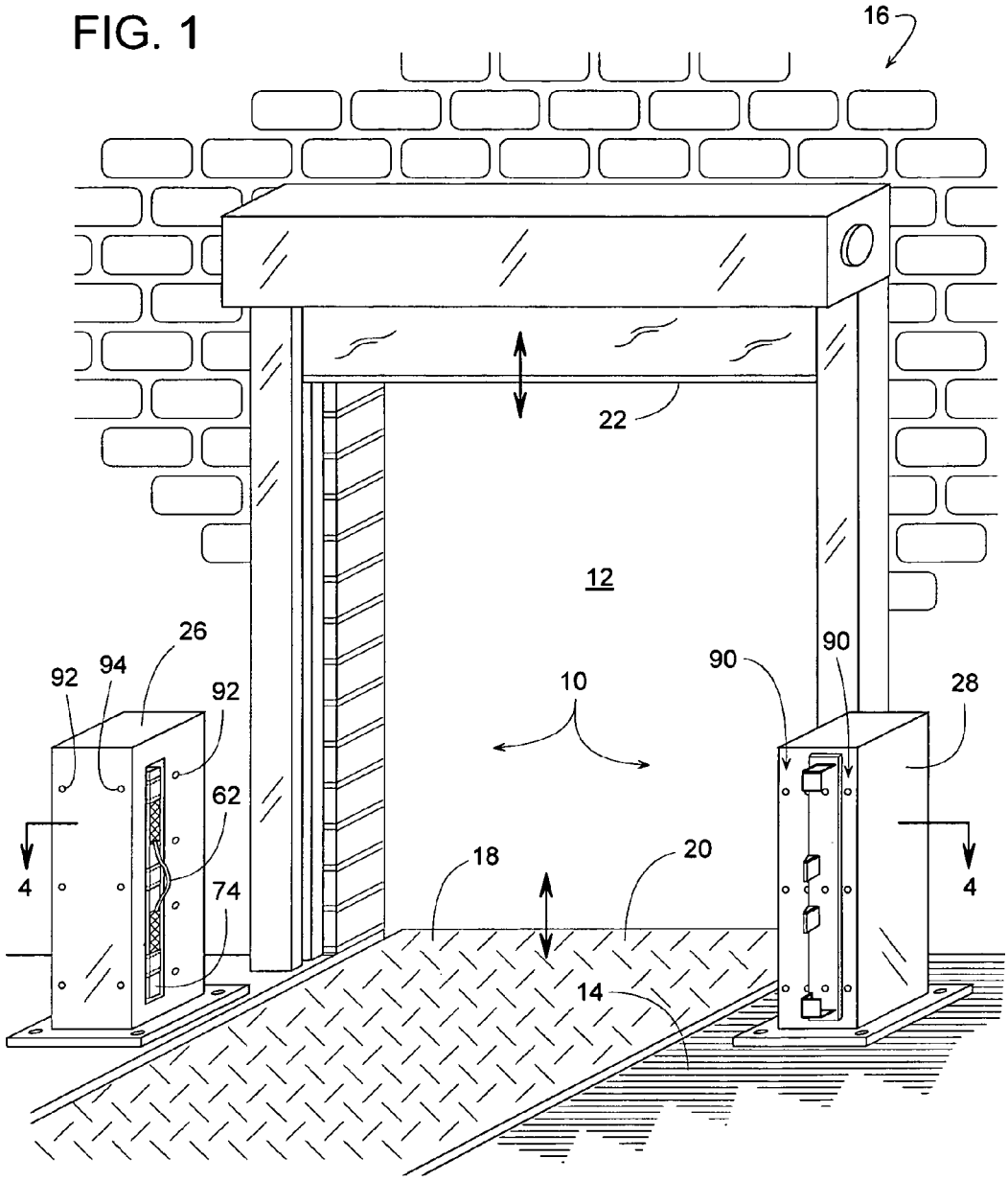
FIG. 1 is a perspective view of a retractable barrier in an open or stored position.
Figure 2:
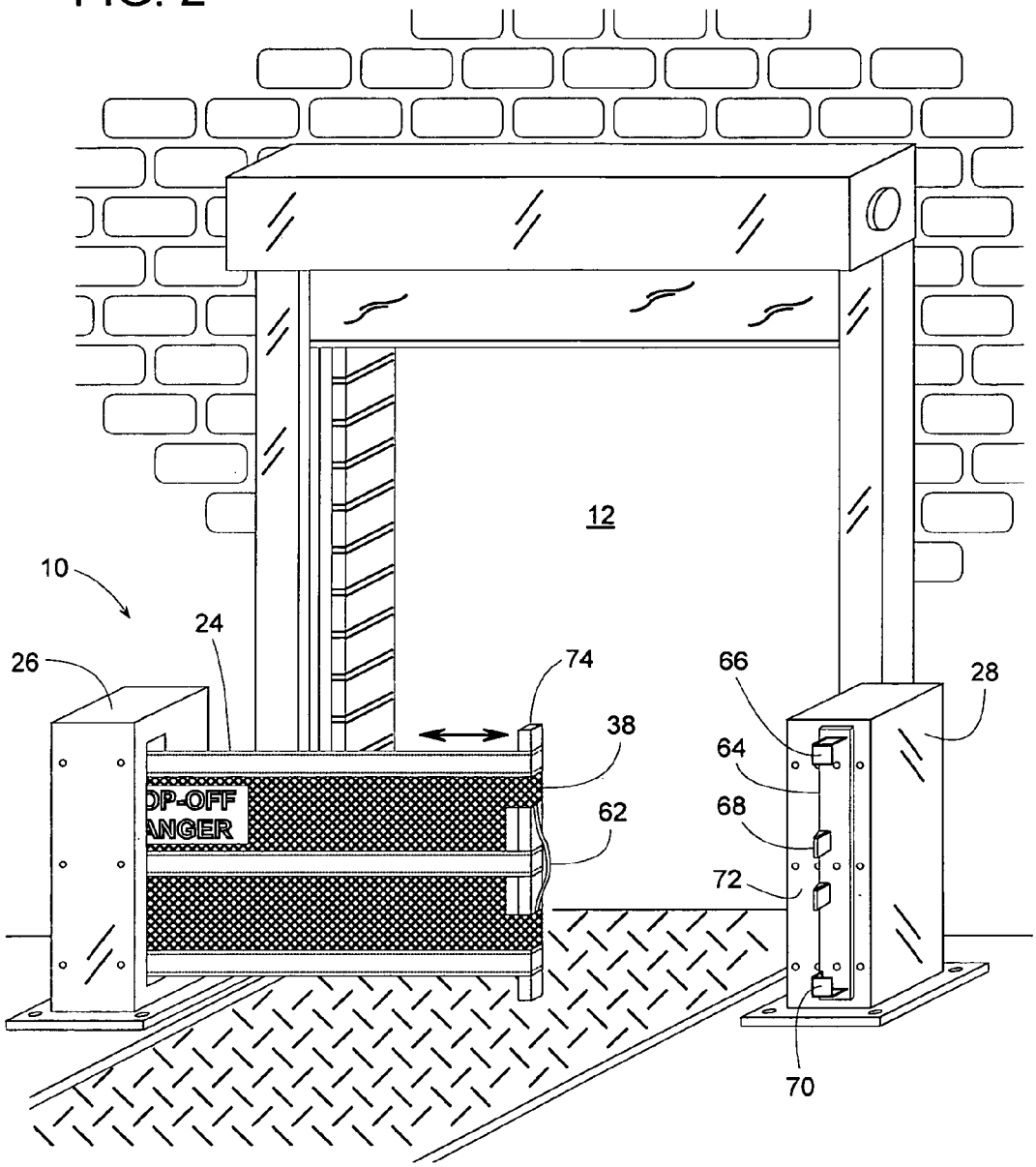
FIG. 2 is a perspective view of the retractable barrier of FIG. I but showing the barrier partially open.
Figure 3:
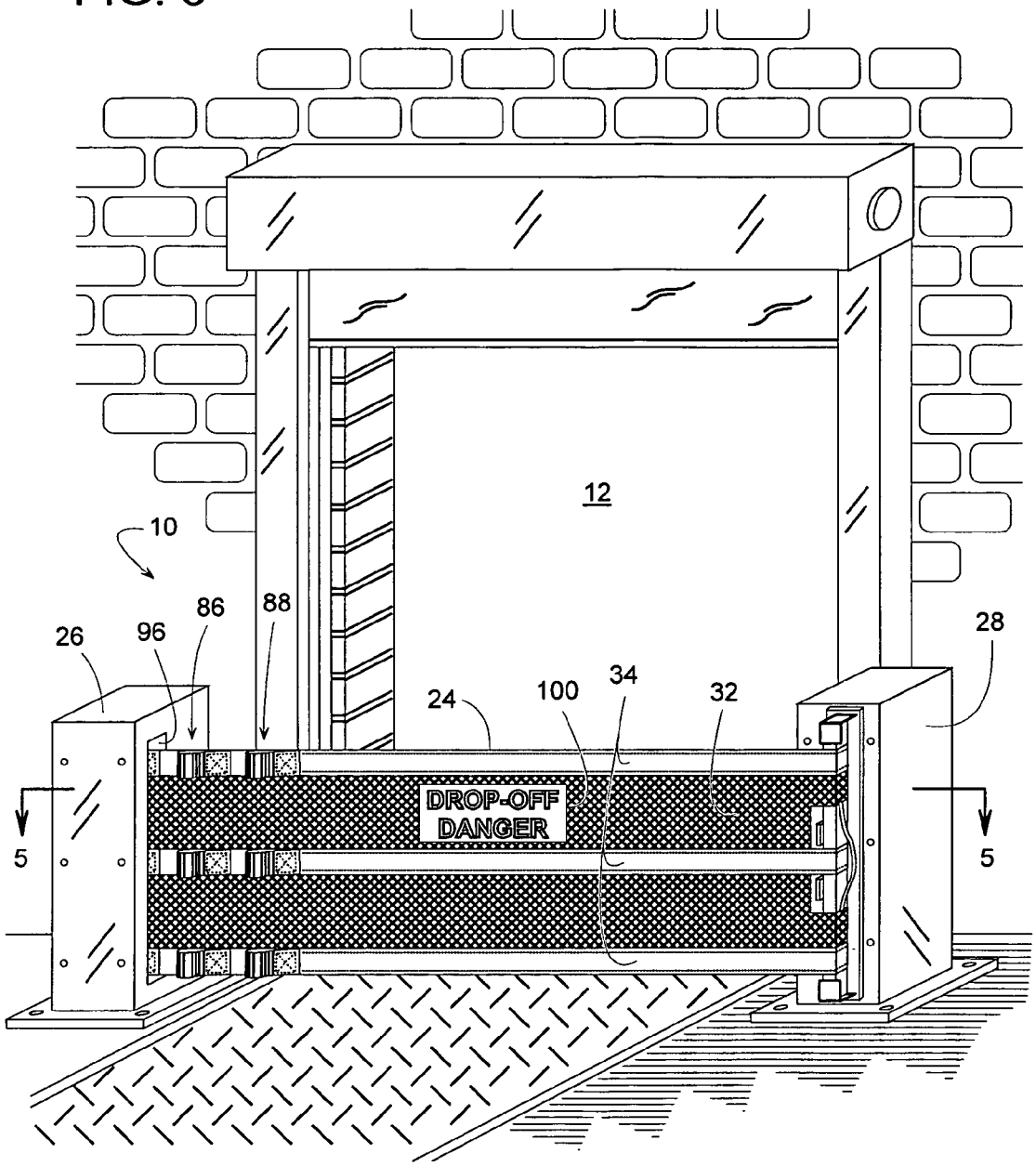
FIG. 3 is a perspective view of the retractable barrier of FIG. I but showing the barrier in a blocking position.

A retractable safety barrier 10 primarily intended for heavy duty industrial use is shown in FIGS. 1-3. The drawing figures show a view from within a building looking out through an open doorway 12. FIG. 1 shows barrier 10 in an open stored position, FIG. 3 shows barrier 10 in a blocking position, and FIG. 2 shows barrier 10 partway between its open and blocking positions.

Although barrier 10 is particularly suited for installation on an elevated platform 14 of a loading dock 16, barrier 10 can be readily applied to a broad range of heavy and light duty applications including, but not limited to, guarding machinery, guarding construction sites, restricting vehicular and pedestrian traffic, restraining cargo, restraining stock stored on high pallet racks, etc. Since the structure and function of various embodiments of barrier 10 may be similar regardless of the barrier's specific application, barrier 10 will be described with reference to its installation at loading dock 16.

Loading dock 16 may include a conventional dock leveler 18 whose pivotal deck 20 is presently shown at its cross-traffic position where the top surface of deck 20 is generally flush with platform 14. Dock 16 also includes a door 22 that can provide access to a truck parked at the dock. When a truck is not present, door 22 is normally closed and the need for barrier 10 may not be apparent; however, the strength of door 22 may be insufficient to withstand the impact of a forklift. In some cases, door 22 may be left open, as shown, even though no truck is present. If the weather outside is mild, for instance, door 22 may be left open to help ventilate the building.

Whether door 22 is open or closed while no truck is present at the dock, platform 18 may create a falling hazard. A dockworker or material-handling vehicle, such as a forklift, may accidentally travel off the edge of platform 14 and fall onto the driveway just beyond doorway 12. To help prevent such an accident, some type of barrier could be installed across the doorway. The barrier, however, should preferably be movable to permit loading or unloading a truck at the dock, not interfere with the operation of the door, permit the operation of the dock leveler, and not obstruct traffic in the vicinity of the dock.

To accomplish all of this, in one embodiment, barrier 10 comprises a retractable panel 24 that can selectively extend and retract between two support members, which will be referred to as a first support member 26 and a second support member 28. Support members 26 and 28 may be attached to the floor of platform 18, attached to the wall of a building, and/or connected to adjacent structure (e.g., a doorway frame, door guide, etc.), wherein the adjacent structure is in turn attached to the building wall or the floor. In some cases, support members 26 and 28 are self-supporting members, wherein the members 26 and 28 are able to self-support their upper ends by simply having their lower ends be anchored to the floor. In some cases, support members 26 and 28 may be referred to as a "post," wherein the term "post" refers to a member whose primary source of support comes from the floor. In a currently preferred embodiment, the "retractable" feature of panel 24 is provided by panel 24 being a pliable roll-up panel that retracts by wrapping about a roller 30, wherein roller 30 is just one example of a take-up member. Other methods of retracting a panel include, but are not limited to, folding or translating interconnected sections of the panel.

Figure 4:
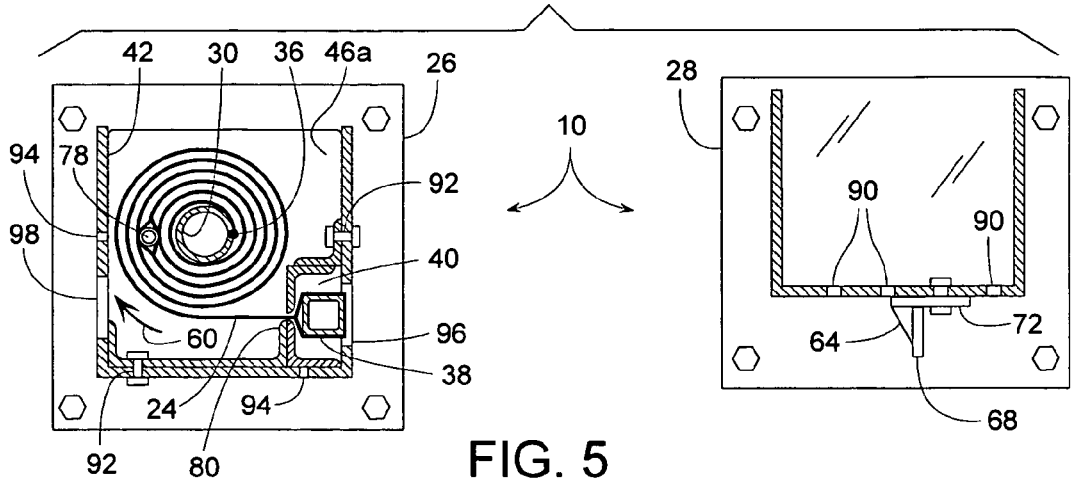
FIG. 4 is a cross-sectional view taken along line 4-4 of FIG. 1.
Figure 5:
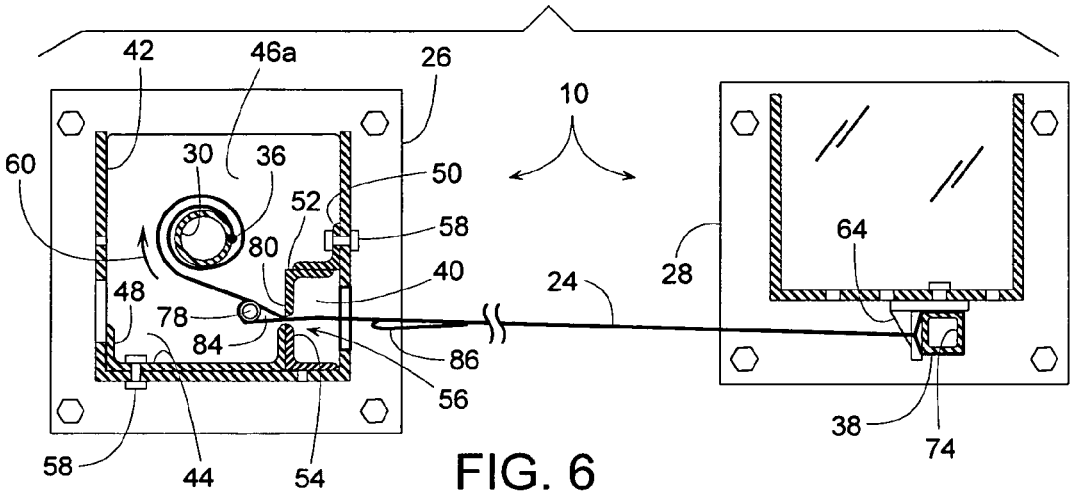
FIG. 5 is a cross-sectional view taken along line 5-5 of FIG. 3.

When panel 24 is pulled out from within first support member 26 and coupled to support member 28, as shown in FIGS. 3 and 5, panel 24 provides a barrier that helps prevent people and vehicles from accidentally falling off the edge of platform 14. When panel 24 retracts to its stored position of FIGS. 1 and 4, barrier 10 permits normal operation of the loading dock.

For the illustrated embodiment, of FIG. 3, panel 24 comprises a fabric web 32 reinforced by one or more straps 34 made nylon or some other a high-test belting material. A proximal end 36 (FIG. 5) of panel 24 connects to roller 30, and a distal end 38 of panel 24 can be selectively stored within a pocket 40 of first support member 26 or releasably coupled to second support member 28.

In some cases, referring to FIG. 5, first support member 26 comprises a housing 42 that contains a frame 44, which in turn supports roller 30. Frame 44 comprises matching upper and lower plates 46*a* and 46*b* (FIG. 8) with vertically elongate structural members 48, 50, 52 and 54 interposed between the two plates. Members 52 and 54 define a slot 56 and pocket 40. Members 48 and 50 enable conventional fasteners 58 to fasten frame 44 within housing 42. The orientation of frame 44 within housing 42 may be based on which side of the doorway support member 26 is to be installed. This feature will be explained later.

Roller 30 is installed between the upper and lower plates 46*a* and 46*b* with panel 24 extending through slot 56. The main section of panel 24 is sufficiently thin to slide through slot 56 with the proximal end 36 of panel 24 being inside housing 42 and the distal end 38 of panel 24 being on the other side of slot 56.

To urge roller 30 to its stored position, roller 30 is preferably associated with a retracting mechanism, such as a conventional torsion spring 60, which is schematically depicted by an arrow that indicates the direction that spring 60 urges roller 30. When panel 24 disconnects from second support member 28, spring 60 acting upon roller 30 draws panel 28 into first support member 26 for storage.

Figure 6:
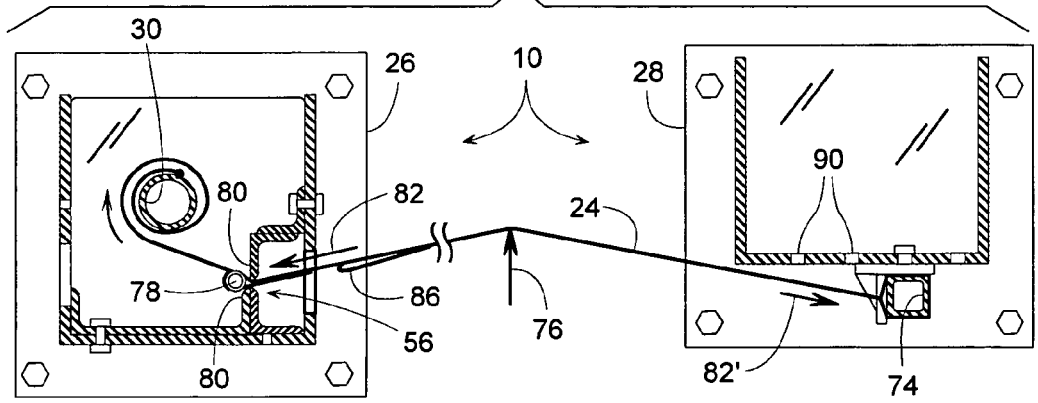
FIG. 6 is a cross-sectional view similar to FIG. 5 but showing the panel experiencing an impact.
Figure 7:
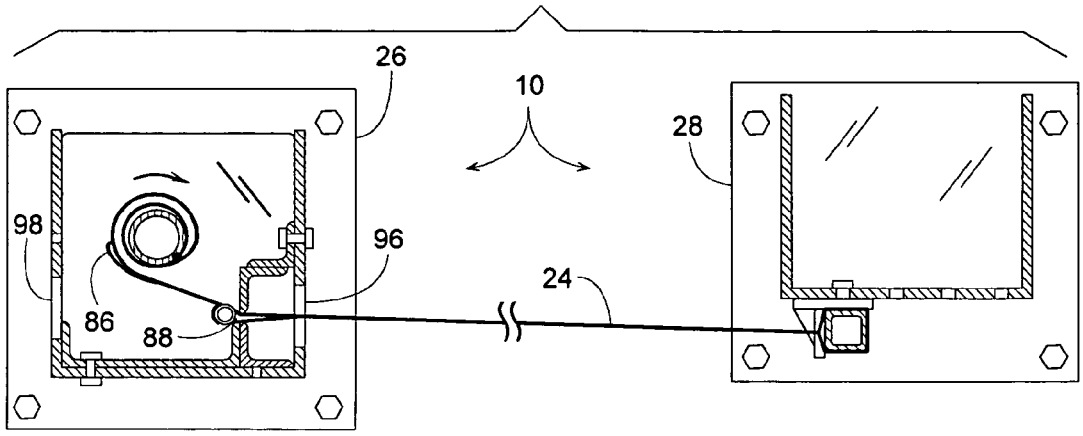
FIG. 7 is a cross-sectional view similar to FIG. 5 but with the barrier being set for a narrower doorway.

Referring to FIG. 2, to move barrier 10 to its blocking position, a pliable handle strap 62 on distal end 38 can be used to manually pull rollup panel 24 onto a hook assembly 64 of second support member 28. Hook assembly 64 includes one or more hooks, such as hooks 66, 68 and 70, which can be welded to a plate 72, which in turn is bolted to the main section of support member 28. To couple panel 24 to support member 28, the distal end 38 of panel 24 includes a metal bar 74 that can be hooked onto hook assembly 64. When panel 24 is in its stored position, bar 74 can stow within pocket 40 so as not to interfere with nearby traffic. When panel 24 is at its blocking position, bar 74 being vertically elongate helps distribute a force of impact 76 (FIG. 6) more evenly along the vertical span of panel 24.

To prevent impact force 76 from pulling panel 24 out from within first support member 26 or damaging roller 30 and its retracting mechanism, panel 24 carries a stop member 78, such as a pipe, bar, or other structure that is too thick to fit through slot 56. The structure surrounding slot 56 serves as a catch member 80 that prevents panel 24 from pulling stop member 78 out through slot 56. Thus, most of a reactive force 82 that opposes impact force 76 passes through panel 24 and first support member 26 and bypasses roller 30 due to the interaction between stop member 78 and catch member 80. Stop member 78 is preferably vertically elongate to evenly distribute reactive force 82 across the height of panel 24.

To fit barrier 10 to various width doorways, stop member 78 can be selectively inserted into one of several possible sleeves 84, 86 or 88 that are sewn or otherwise attached to panel 24. In this example, each sleeve comprises three vertically spaced apart loops formed of the same material as the panel's reinforcing straps. Stop member 78 is inserted in the selected sleeve while that sleeve is on the roller side of slot 56, thus the chosen sleeve determines how far panel 24 can extend out from within first support member 26.

The horizontal spacing between sleeves 84, 86 and 88 enables the length of barrier 10 to be adjusted in discrete increments equal to the spacing between adjacent sleeves. Finer length adjustments can be achieved by changing the location of where mounting plate 72 of hook assembly 64 is attached to support member 28. In selecting a location, second support member 28 includes several series of mounting holes 90 from which to choose. The actual spacing between adjacent sleeves of panel 24, and the spacing between adjacent vertical rows of holes 90 can vary depending on the design; however, in some embodiments sleeves 84, 86 and 88 are spaced at twelve-inch increments, and the rows of holes 90 are horizontally spaced at three-inch increments, so the extended length of panel 24 can be adjusted in three-inch increments over a length of 24 inches.

Figure 8:
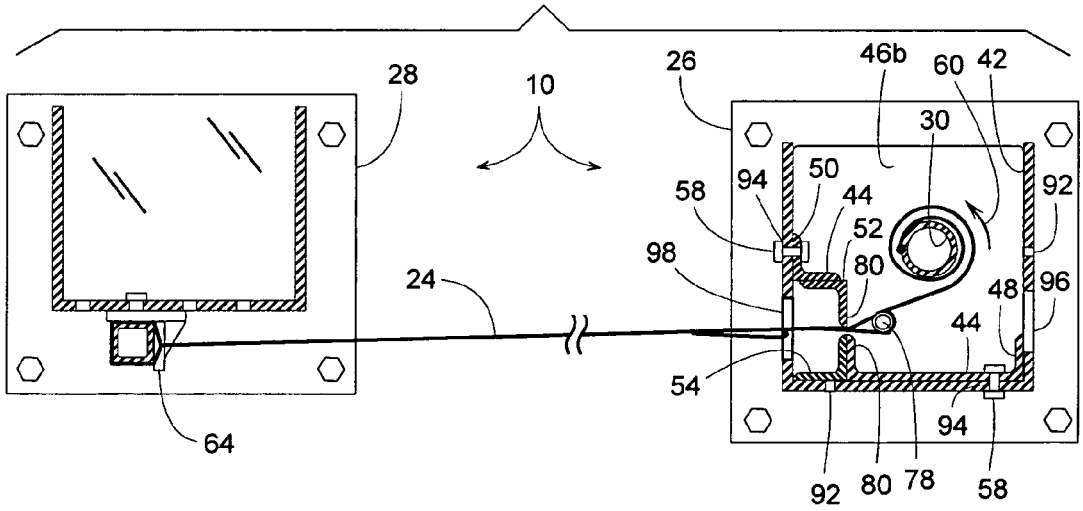
FIG. 8 is a cross-sectional view similar to FIG. 5 but with the location of the barrier's two support members being interchanged.

Minor reconfiguration of support members 26 and 28 allow interchanging their locations so that either support member can be on the right or left side of a doorway. For doorway 12, for example, support members 26 and 28 can be reinstalled as shown in FIG. 8. To do this, frame 44 is inverted on first support member 26, and hook assembly 64 is inverted on second support member 28. Hook assembly 64 can be inverted by using the same mounting holes 90. To permit the inverted installation of frame 44, however, housing 42 is provided with two sets of mounting holes 92 and 94 from which to choose. Housing 42 also includes a right-hand opening 96 and a similar left-hand opening 98 through either of which panel 24 can extend depending on the orientation of frame 44 within housing 42. While the components of the retractable safety barrier system may be configured in various ways, the system preferably includes a first support member, a second support member spaced from the first support member, a resilient barrier capable of spanning between the support members, a take-up member coupled to the resilient barrier, and an incremental stop means coupled to the resilient barrier such that most of the impact is reacted by the first support member.

To warn others in the area of dock 16 that a drop-off hazard may exist, even when door 22 is closed, panel 24 may be of contrasting colors (e.g., red and yellow, black and yellow, etc.). In some embodiments, for example, straps 34 are yellow and web 32 is red. Alternatively or in addition to, a warning label 100 can be prominently displayed on panel 24 to suggest that a safety hazard exists.

Figure 9:
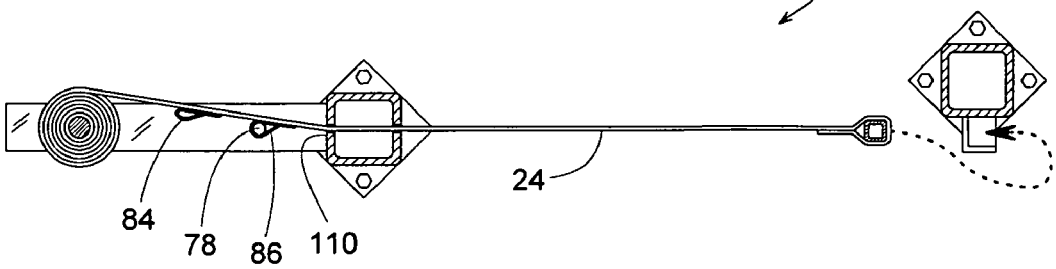
FIG. 9 is a cross-sectional view taken along line 9-9 of FIG. 10.
Figure 10:
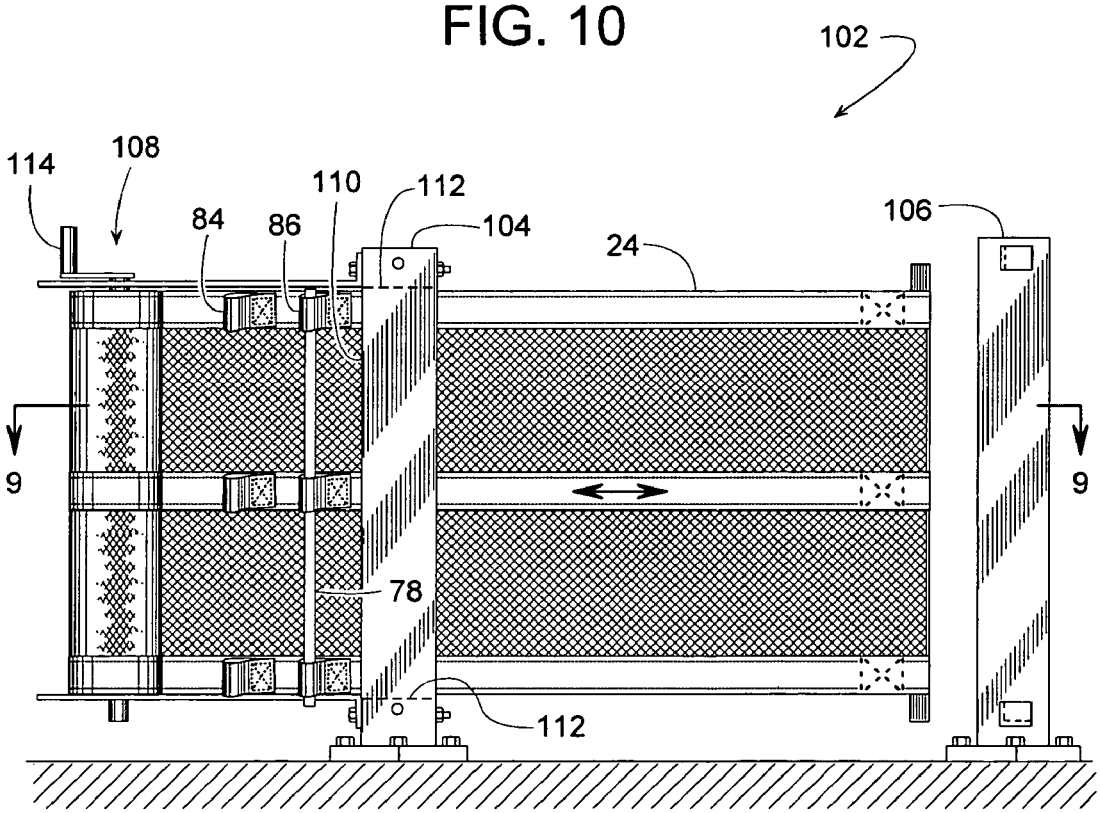
FIG. 10 is a front view of another embodiment of a retractable barrier.

FIGS. 9 and 10 illustrate an alternate barrier system 102 that is similar to barrier system 10 but without housing 42. System 102 comprises two force-reacting support members 104 and 106, a take-up member 108 in the form of a roller for storing the unused portion of flexible barrier 24 (retractable fabric panel, multiple straps, single strap, etc.), and stop member 78 that works in conjunction with a catch member 110 for limiting the extent to which barrier 24 can be extended and for transferring impact forces from barrier 24 to support member 104. To create catch member 110, support member 104 includes a slot 112 that is sized to receive barrier 24 but is too narrow for stop member 78. Stop member 78 can be selectively inserted in loops 84 or 86 to adjust the stop position of barrier 24. A crank 114, spring, or some other type of recoil mechanism can be added to help rewind barrier 24 onto take-up member 108. In this embodiment, take-up member 108 is mounted to support member 104; however, take-up member 108 could alternatively be mounted to its own separate support column.

Figure 11:
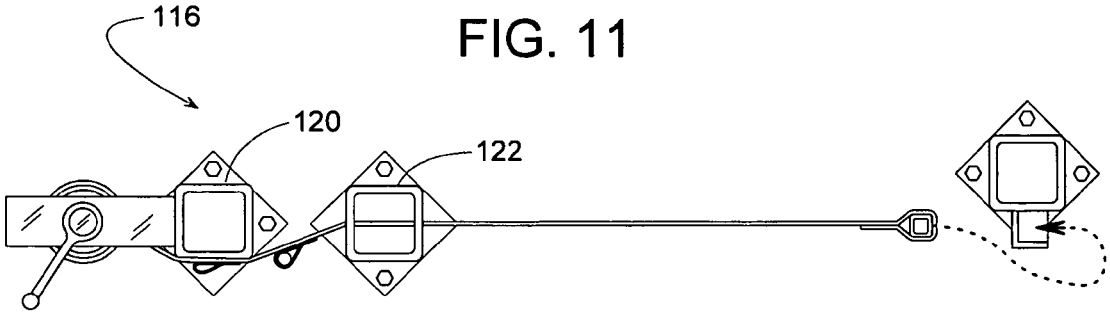
FIG. 11 is a top view of FIG. 12.
Figure 12:
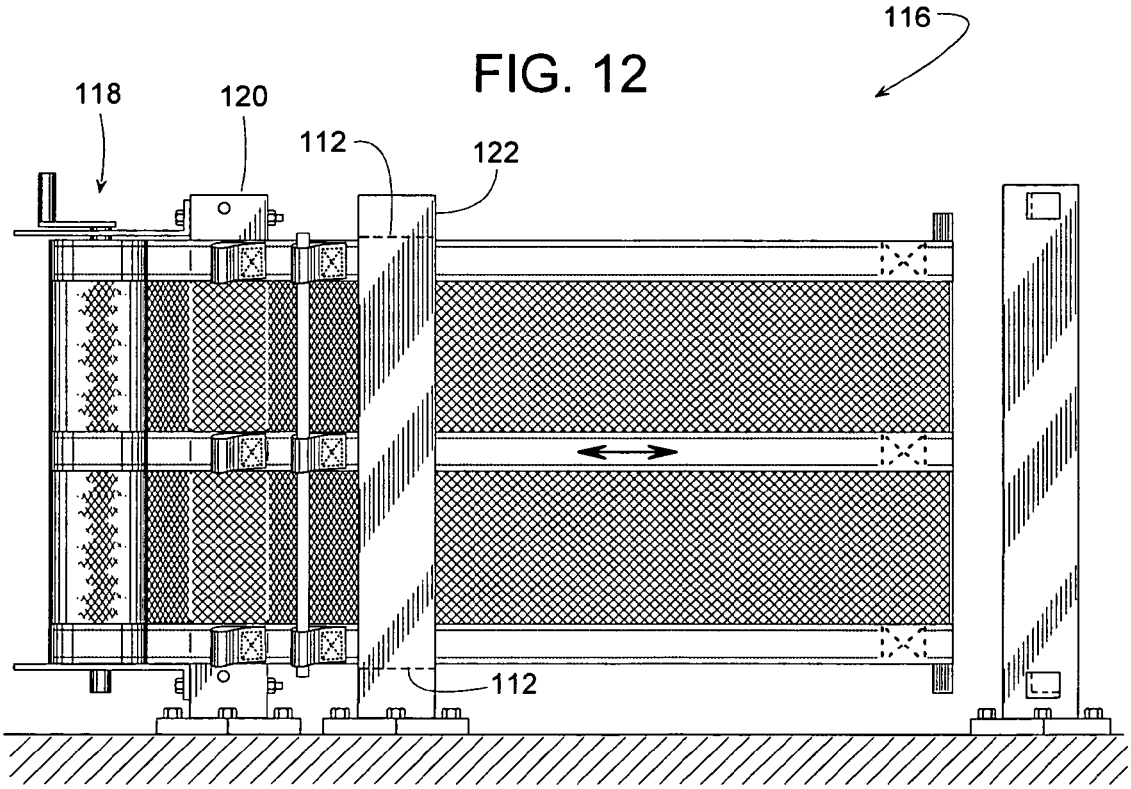
FIG. 12 is a front view of another embodiment of a retractable barrier.
Figure 13:
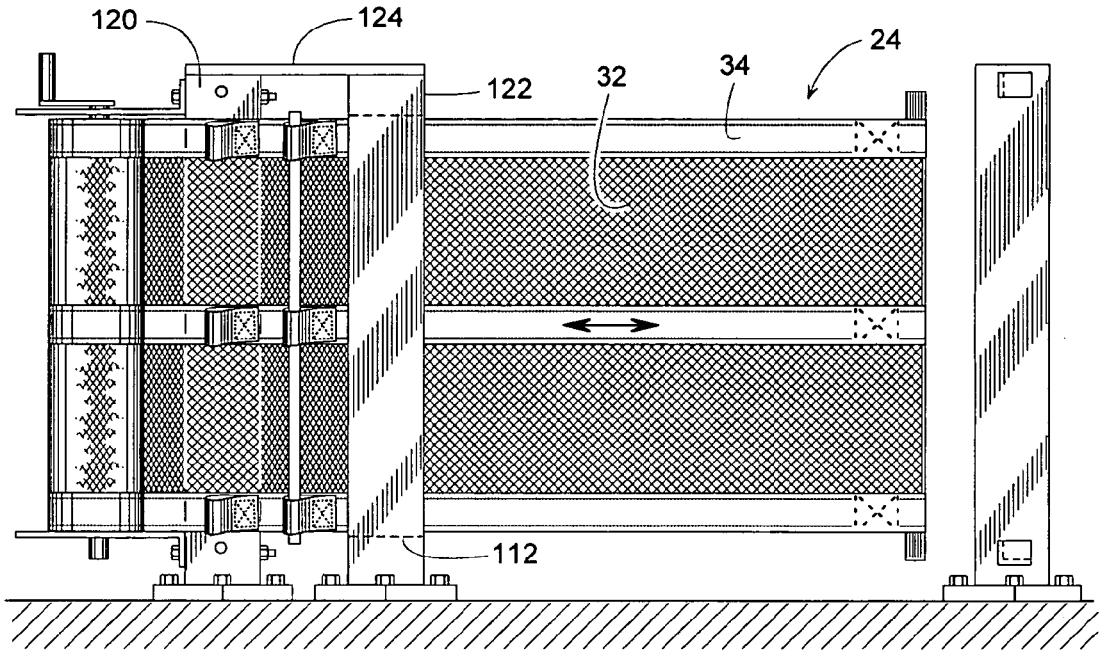
FIG. 13 is a front view of another embodiment of a retractable barrier.

For barrier system 116 of FIGS. 11 and 12, for instance, a take-up member 118 is mounted to a separate post 120 that can be anchored to the floor at a position spaced apart from a force-reacting support member 122. For greater strength and rigidity, post 120 and support member 122 can be connected by one or more cross-members 124 to create a double-post structure, as shown in FIG. 13. With cross-member 124, post 120 can help support member 122 in reacting to an impact against barrier 24.

Figure 14:
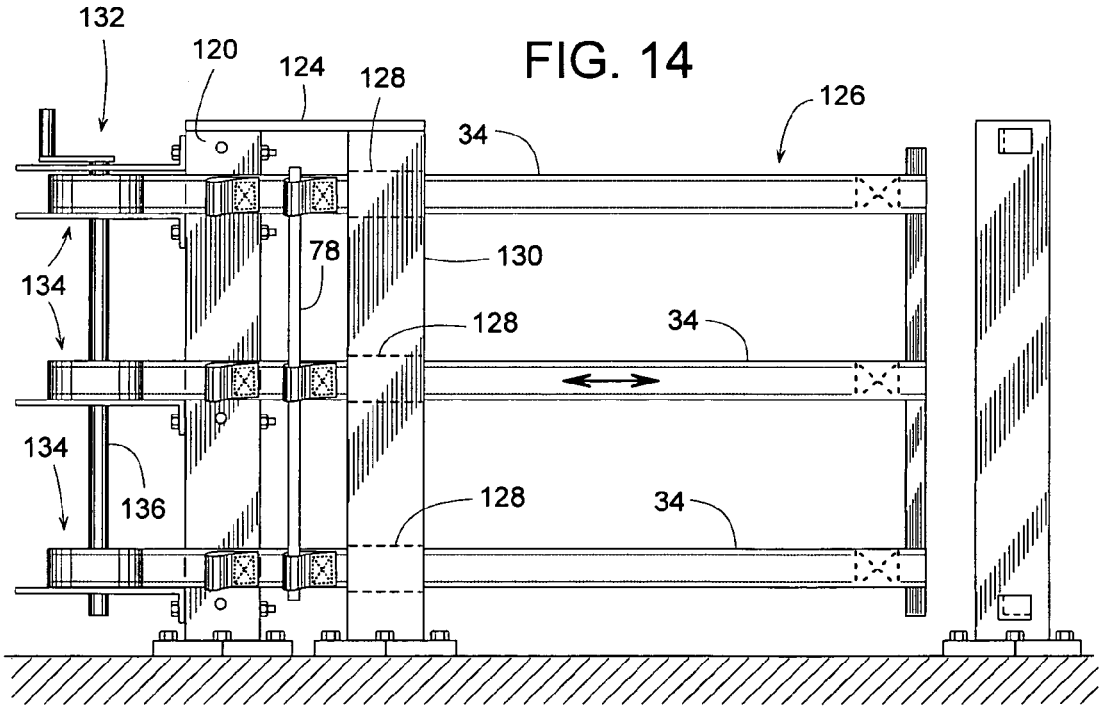
FIG. 14 is a front view of another embodiment of a retractable barrier.
Figure 15:
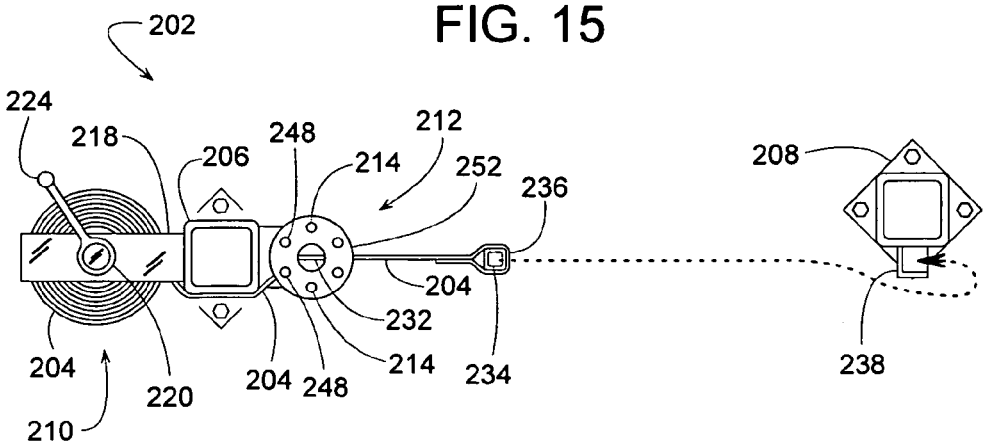
FIG. 15 is a top view of a retractable barrier being extended to a second support member from an open or stored position on a first support member.
Figure 16:
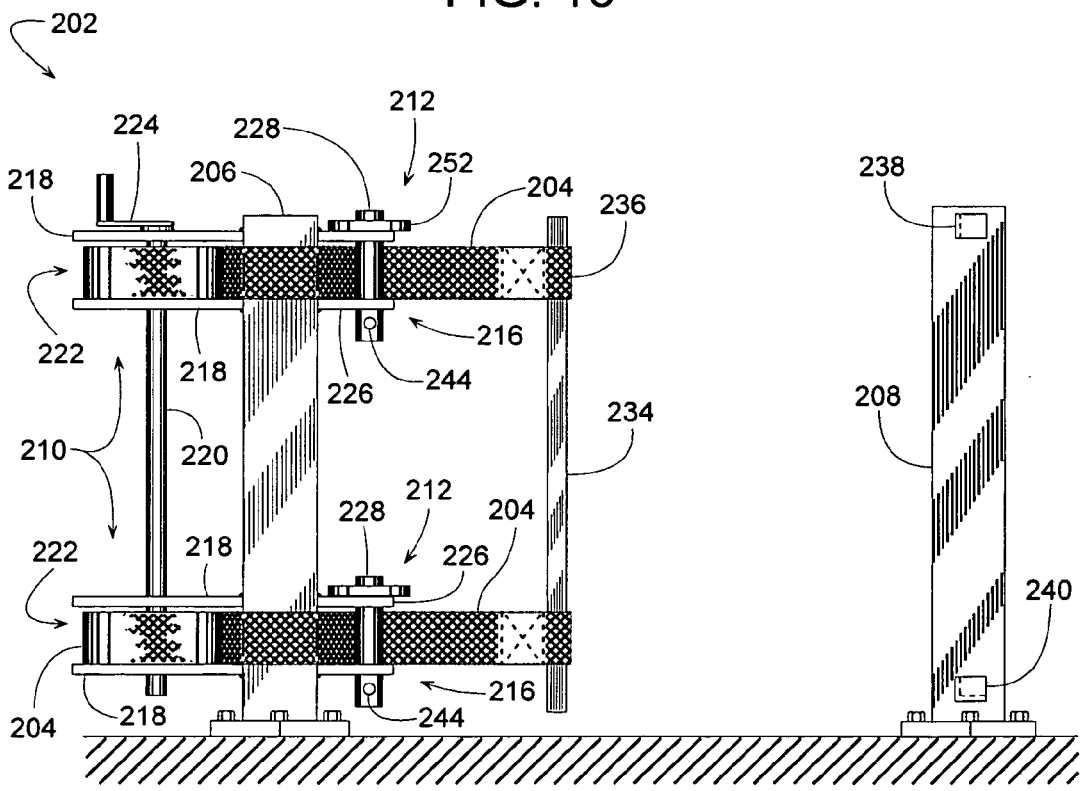
FIG. 16 is a front view of FIG. 15.

FIG. 14 is similar to FIG. 13; however, web 32 is omitted to create a barrier 126 that comprises one or more straps 34. The individual straps 34 feed through corresponding individual slots 128 in a support member 130 rather than feeding through one long slot 112 in support member 122 of FIGS. 12 and 13. To support the unused portions of the individual straps 34, a take-up member 132 includes a corresponding number of individual rollers 134. Rollers 134 could rotate in unison by sharing a common shaft 136, as shown. Alternatively, rollers 134 could be set up to rotate independently of each other. It should be noted that post 120 and cross-member 124 could be eliminated by mounting take-up member 132 to support member 130, similar to barrier system 102 of FIGS. 9 and 10.

In another embodiment, shown in FIGS. 15-19, a barrier system 202 includes a retractable panel, such as a strap 204, which can be stored at a first support member 206 when not in use or extended between support member 206 and a second support member 208 when in use. Attached to first support member 206 is a first take-up member 210 for storing strap 204, an incremental stop mechanism 212 for providing strap 104 with a plurality of spaced-apart stopping points 214, and a second take-up member 216 for adjusting the tension in strap 204 with infinite adjustability.

Although the actual structure of first take-up member 210, second take-up member 216, and incremental stop mechanism 212 may vary, in some embodiments, first take-up member 210 comprises a plurality of arms 218 attached to first support member 206. A vertical rod 220 extends through arms 218 to create one or more spools 222 about which one or more straps 204 can be wrapped for storage. A crank 224 can be attached to rod 220 to make it easier to wrap straps 204 onto spools 222.

Second take-up member 216 may also comprise a plurality of arms 226 attached to first support member 206. Upper and lower pins 228 are supported for rotation within arms 226, and each pin 228 has a slot 230 through which a section 232 of strap 204 extends so that straps 204 wrap around their respective pins 228 upon rotating the pins. When a bar 234 at a distal end 236 of straps 204 engages hooks 238 and 240 on second support member 208, as shown in FIGS. 17 and 18, straps 204 can be tightened in tension by rotating pins 228. To rotate pins 228 with greater torque, a removable lever arm 242 can be inserted through a hole 244 in pin 228. Two separate pins 228 allow straps 208 to be tightened and locked individually.

Once straps 204 are tightened, incremental stop mechanism 212 firmly holds pins 228 and straps 204 at their tightened positions so that straps 204 and second take-up member 216 can react to an impact against straps 204 without having to rely on a frictional locking mechanism. Moreover, stop mechanism 212 allows second take-up member 216 and first support member 206 to react to the impact rather than transferring the impact to the relatively light duty first take-up member 210.

In some embodiments, incremental stop mechanism 212 comprises an alignment pin 246 that can be inserted through aligned holes 250 and 248 respectively in arm 226 and a flange 252 attached to pin 228, thereby locking flange 252 to arms 226. When alignment pin 246 is removed, flange 252 and holes 248 can rotate with pin 228, while arms 226 and holes 250 remain stationary. Alignment pin 246 can be a single linear pin, a U-shaped pin, or some other appropriate shape.

While incremental stop mechanism 212 provides a plurality of discrete, spaced apart stopping points 214 defined by holes 248 in flange 252, second take-up member 216 can be operated such that a variable amount of strap 204 can be wrapped onto pin 228 to provide infinitely variable tension adjustment of strap 204. Referring to FIG. 19, a portion 254 of strap 204, for example, can be folded onto itself to infinitely vary the effective length of strap 204. The folded portion 254 of strap 204 can be strapped in place by rotating pin 228 until a sufficient amount of additional strap 256 overlies the folded portion 254, whereby the folded portion 254 becomes clamped between pin 228 and the outer wrap 256 of strap 204. The selectively variable length of folded portion 254 is what provides infinite adjustment between the incremental stopping points 214. It should be noted that the length of folded portion 254 could extend multiple revolutions around pin 228 depending on the extent to which pin 228 is rotated.

Figure 20:
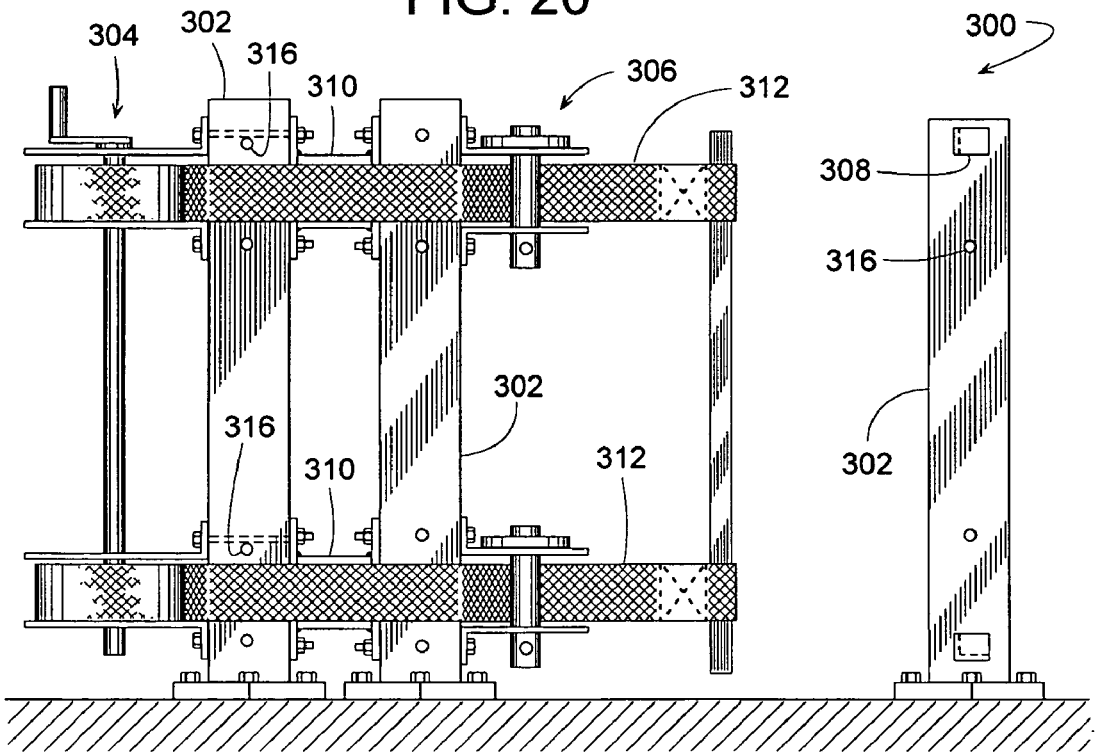
FIG. 20 is a front view of another embodiment of a retractable barrier.

Many of the features illustrated in FIGS. 1-19 can be selectively chosen and combined in different ways to create numerous other embodiments. A modular, bolt-together barrier system 300 of FIG. 20, for instance, is similar to system 102 of FIGS. 15-19; however, system 300 is shown assembled as a double-post design similar to FIGS. 13 and 14.

Figure 21:
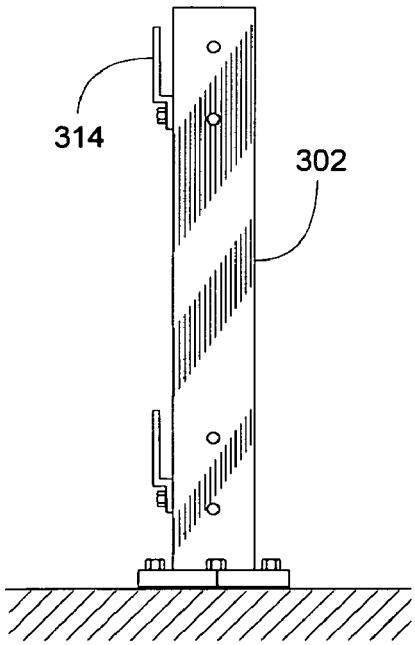
FIG. 21 is a front view of a post with a bracket mounted to it.
Figure 22:
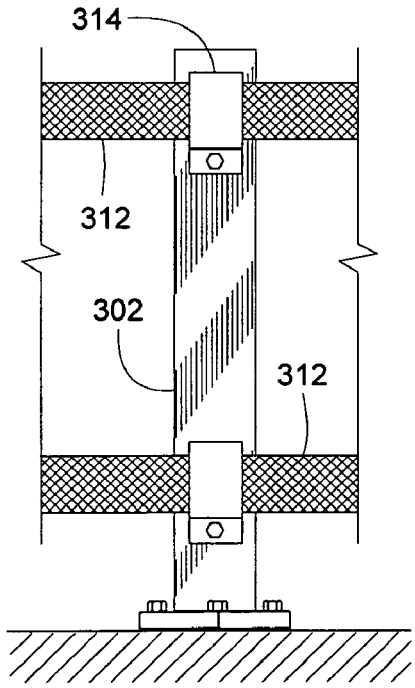
FIG. 22 is a side view of FIG. 21.

Modular components of barrier system 300 include a post 302 (similar to support member 120 of FIG. 12), a take-up member 304 (similar to take-up member 210), stop member 306 (similar to stop mechanism 212), a retainer 308 (similar to hook assembly 64 or hooks 66, 68 or 70), and a cross-member 310 (similar to cross-member 124), and a barrier 312 (similar to barrier 126 of FIG. 14). Referring further to FIGS. 21 and 22, barrier system 300 may also include a strap support bracket 314 that can be bolted to post 302. Bracket 314 and post 302 can be used to help support barriers at some intermediate position along the barrier's length.

To facilitate the modularity of barrier system 300, post 302 includes a plurality of cross-drilled thru-holes 316 for mounting take-up members 304, cross-members 310, stop members 306, retainers 308, and brackets 314 in various configurations. One set of holes 316 passes through post 302 in one direction and another set runs perpendicular to the first. One set is a bolt-diameter higher than the other so that two perpendicular bolts can pass through post 302 at approximately the same elevation without interference.

Figure 23:
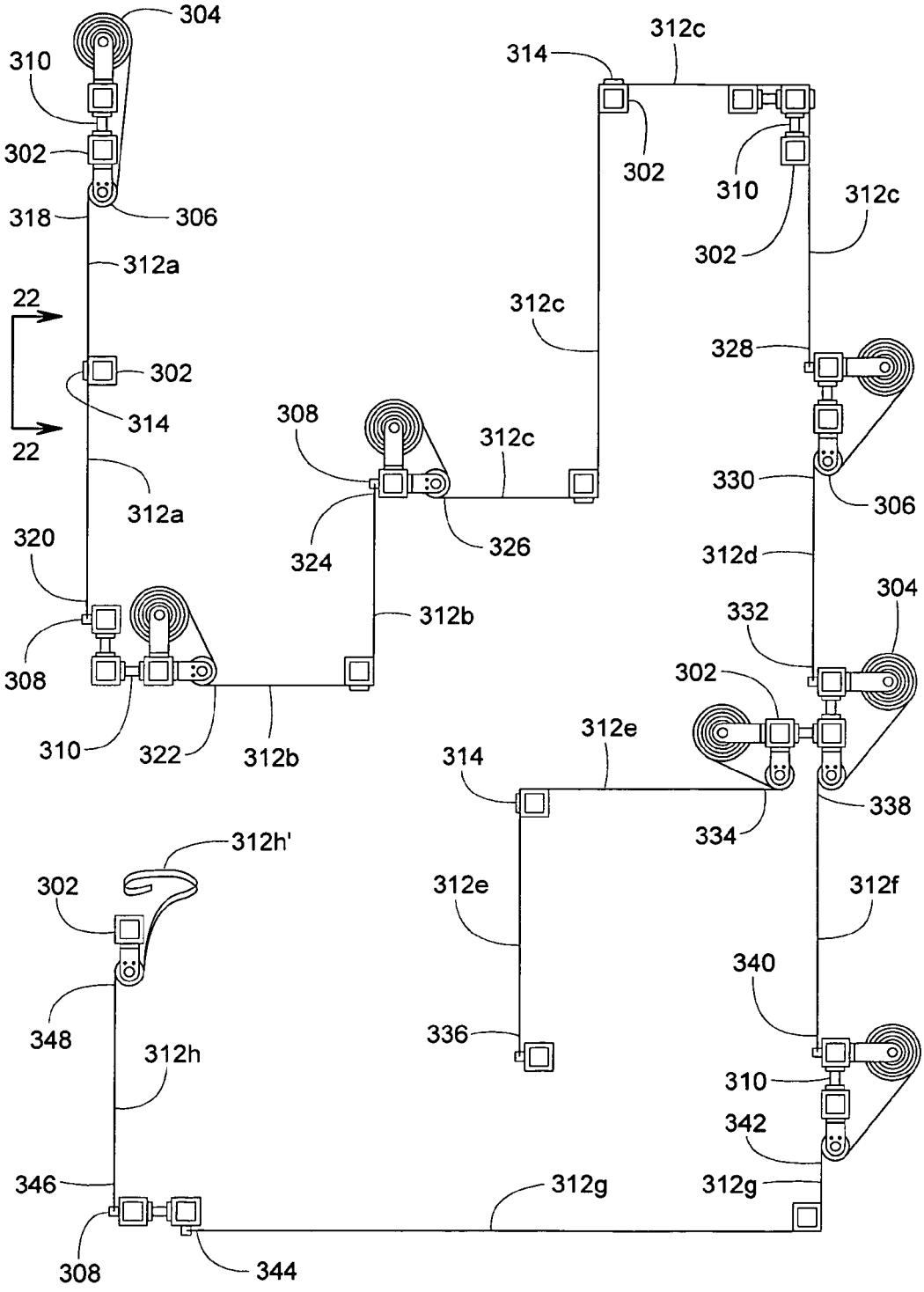
FIG. 23 is a schematic top view showing various configurations of a modular barrier system.

The modular components of system 300 can be assembled in an infinite number of configurations. FIG. 23 illustrates just one possible layout. In this example, a barrier 312*a* is held in tension between points 318 and 320, a barrier 312*b* is held in tension between points 322 and 324, a barrier 312*c* is held in tension between points 326 and 328, a barrier 312*d* is held in tension between points 330 and 332, a barrier 312*e* is held in tension between points 334 and 336, a barrier 312*f* is held in tension between points 338 and 340, a barrier 312*g* is held in tension between points 342 and 344, and a barrier 312*h* is held in tension between points 346 and 348. In some cases, to avoid the cost of take-up member 304, an unused portion 312*h'* of the barrier may be left just lying on the floor, as shown, or stored in some other uncoiled fashion.

As detailed above, the geometry of the individual components of the retractable safety barrier system may vary, and the components may be assembled in a variety of ways. However, each embodiment of the retractable barrier system disclosed above preferably includes a first support member, a second support member spaced from the first support member, a resilient barrier capable of spanning between the support members, a take-up member coupled to the resilient barrier to selectively take-up the resilient barrier, and an incremental stop means coupled to the resilient barrier such that most of the impact is reacted by the first support member.

Although the invention is described with reference to a preferred embodiment, it should be appreciated by those of ordinary skill in the art that various modifications are well within the scope of the invention. Therefore, the scope of the invention is to be determined by reference to the following claims:

We claim:

1. A barrier system that may be subject to an impact, the barrier system comprising:

a first support member;

a first take-up member;

a second support member laterally spaced apart from the first support member such that a horizontal gap exists between the first support member and the second support member;

a flexible barrier adapted to receive the impact, the flexible barrier includes a proximal end attached to the first take-up member and a distal end that can be releasably coupled to the second support member, wherein the flexible barrier can selectively retract onto the first take-up member and extend out in a direction toward the second support member; and incremental stopping means that provide a plurality of discrete, spaced-apart stopping points that limit an extent to which the flexible barrier can extend in the direction toward the second support member, the incremental stopping means being coupled to the flexible barrier and the first support member such that more of the impact can be reacted by the first support member than by the first take-up member.

2. The barrier system of claim 1, wherein the first take-up member is supported by the first support member.

3. The barrier system of claim 1, wherein the incremental stopping means include a plurality of sleeves defined by the retractable panel.

4. The barrier system of claim 3, wherein the incremental stopping means further include a stop member that can be selectively inserted into at least one of the plurality of sleeves.

5. The barrier system of claim 4, wherein the incremental stopping means further include a catch member disposed on the first support member and being associated with the stop member such that the catch member impedes the movement of the stop member to limit an extent to which the flexible barrier can extend in the direction toward the second support member.

6. The barrier system of claim 5, wherein the first support member defines a slot whose surrounding structure is the catch member.

7. The barrier system of claim 1, further comprising a second take-up member coupled to the flexible barrier and the first support member, wherein a variable amount of the flexible barrier can be wrapped onto the second take-up member to provide infinitely variable tension adjustment of the flexible barrier.

8. The barrier system of claim 7, wherein the second take-up member is coupled to the incremental stopping means.

9. The barrier system of claim 7, wherein the flexible barrier has a first portion supported by the first take-up member and a second portion supported by the second take-up member such that the first portion is held in greater tension than the second portion when the distal end of the flexible barrier is coupled to the second support member.

10. The barrier system of claim 7, wherein the first take-up member has more capacity to store the flexible barrier than does the second take-up member.

11. The barrier system of claim 7, further comprising a lever arm selectively coupleable to the second take-up member such that the lever arm can transmit to the second take-up member a torque that can tighten the flexible barrier.

12. The barrier system of claim 1, wherein the incremental stopping means comprise a flange with a plurality of holes and an alignment pin that is selectively insertable in the plurality of holes.

13. A barrier system that may be subject to an impact, the barrier system comprising:

a first support member;

a first take-up member associated with the first support member; a second support member laterally spaced apart from the first support member such that a horizontal gap exists between the first support member and the second support member;

a flexible barrier adapted to receive the impact, the flexible barrier includes a proximal end attached to the first take-up member and a distal end that can be releasably coupled to the second support member, wherein the flexible barrier can selectively retract onto the first take-up member and extend out in a direction toward the second support member;

a second take-up member coupled to the flexible barrier and the first support member, wherein a variable amount of the flexible barrier can be wrapped onto the second take-up member to provide infinitely variable tension adjustment of the flexible barrier; and an incremental stop mechanism that provides a plurality of discrete, spaced-apart stopping points that limit an extent to which the flexible barrier can extend in the direction toward the support member, the incremental stop mechanism is coupled to the flexible barrier, the second take-up member, and the first support member such that more of the impact can be reacted by the first support member than by the first take-up member.

14. The barrier system of claim 13, wherein the flexible barrier has a first portion supported by the first take-up member and a second portion supported by the second take-up member such that the second portion is held in greater tension than the first portion when the distal end of the flexible barrier is coupled to the second support member.

15. The barrier system of claim 13, wherein the first take-up member has more capacity to store the flexible barrier than does the second take-up member.

16. The barrier system of claim 13, wherein the incremental stop mechanism defines a plurality of holes and includes an alignment pin that is selectively insertable in the plurality of holes.

17. The barrier system of claim 13, further comprising a lever arm selectively coupleable to the second take-up member such that the lever arm can transmit to the second take-up member a torque that can tighten the flexible barrier.

18. A method of transferring a reactive force responsive to an impact force exerted against a flexible barrier, the method comprising:

anchoring a first support member at a first location;

wrapping the flexible barrier about a substantially vertical axis of a first take-up member supported by the first support member;

extending the flexible barrier from the first support member;

providing an incremental stopping mechanism having a plurality of distinct, spaced apart stopping points which inhibit an extent to which the flexible barrier can extend from the first support member, wherein the extent is determined by selecting a stopping point from the plurality of discrete, spaced-apart stopping points; and transmitting the reactive force through the flexible barrier and through the first support member, such that most of the reactive force bypasses the first take-up member.

19. The method of claim 18, further comprising wrapping the flexible barrier about a second take-up member supported by the first support member such that the second take-up member transmits more of the reactive force than does the first take-up member.

20. The method of claim 18, wherein the plurality of discrete, spaced-apart stopping points are determined by rotation of the second take-up member.

* * * * *